US005442263A

United States Patent [19]

Alig

[11] Patent Number: 5,442,263

[45] Date of Patent: Aug. 15, 1995

[54] DYNAMIC ELECTROSTATIC AND MAGNETIC FOCUSING APPARATUS FOR A CATHODE RAY TUBE

[75] Inventor: Roger C. Alig, Princeton Junction, N.J.

[73] Assignee: David Sarnoff Research Center, Inc., Princeton, N.J.

[21] Appl. No.: 294,712

[22] Filed: Aug. 23, 1994

[51] Int. Cl.[6] ..... H01J 29/58

[52] U.S. Cl. ..... 315/382.1

[58] Field of Search ..... 315/382, 382.1

[56] References Cited

U.S. PATENT DOCUMENTS

| | | | |
|---|---|---|---|
| 2,188,579 | 1/1940 | Schlesinger | 250/157 |
| 2,213,175 | 8/1940 | Iams et al. | 250/158 |
| 2,213,176 | 8/1940 | Rose | 250/153 |
| 3,740,607 | 6/1973 | Silzars et al. | 315/15 |
| 4,044,282 | 8/1977 | Balandin et al. | 315/382 |
| 4,099,088 | 7/1978 | Hart | 313/450 |
| 4,142,133 | 2/1979 | Balandin et al. | 315/382 |
| 4,766,343 | 8/1988 | Belica | 313/412 |
| 4,782,264 | 11/1988 | Yamazaki et al. | 313/413 |
| 4,853,601 | 8/1989 | Odenthal | 315/368 |
| 4,857,796 | 8/1989 | Amamo et al. | 313/428 |
| 5,091,673 | 2/1992 | Shimoma et al. | 313/412 |

OTHER PUBLICATIONS

Furukawa et al., "A 25" High-Resolution Monochrome Monitor, 150 Ft-L, 2048 dots×2560 Lines Magnetic Focus System", pp. 1-5.

Perreaut et al., "45.3: A New Device Concept For CRTs", SID 92 Digest, pp. 885-888.

Lurie et al., "36.6: A 200-fL Monochrome 5 Mpel CRT Monitor", SID 92 Digest, pp. 707-709.

Odenthal, "36.5: A High-Brightness High-Resolution CRT Display", SID 92 Digest, pp. 703-706.

*Primary Examiner*—Theodore M. Blum

*Attorney, Agent, or Firm*—William J. Burke

[57] ABSTRACT

Apparatus, associated with a cathode ray tube (CRT), containing both a electrostatic focusing lens and a magnetic focusing lens for maintaining the focus of an electron beam within the CRT at any location on a CRT screen. The apparatus applies a dynamic focusing voltage to an electrostatic focus grid of an electron gun and applies a dynamic focusing current to a magnetic focus coil. The focusing voltage and current vary in accordance with the position of the electron beam on the screen. As such, the electron beam remains focused upon the screen for all beam positions.

11 Claims, 2 Drawing Sheets

DYNAMIC ELECTROSTATIC AND MAGNETIC FOCUSING APPARATUS FOR A CATHODE RAY TUBE

The United States Government has rights in this invention pursuant to a government contract.

The invention relates to cathode ray tubes and, more particularly, to dynamic electrostatic and magnetic focusing apparatus associated with a cathode ray tube.

BACKGROUND OF THE DISCLOSURE

In general, a cathode ray tube (CRT) contains a vacuum envelope, an electron gun for producing an electron beam and, opposite the electron gun, a screen that is coated with a phosphor material that produces light when impacted by the electron beam. The beam is positioned using a magnetic yoke that responds to control signals from a CRT control circuit that raster scans the electron beam across the screen. Furthermore, as is well known in the art, to properly focus the beam on the screen, a typical CRT uses either a magnetic or electrostatic beam focusing apparatus. The focusing apparatus is generally static in nature, in that, optimal focus is achieved at the center of the screen and the beam becomes defocused at the extreme edges of the screen. In low resolution CRTs, the image produced by the defocused beam is not noticeably distorted.

In some high resolution CRTs, the focusing apparatus (lens) is dynamically adjusted such that the focal length of the focusing apparatus is altered as the beam approaches the edges of the screen. Such dynamic focusing is necessary as the ratio of the distance from the electron gun to the screen at the screen center to the distance from the electron gun to the screen at the screen edge becomes smaller. This ratio is referred to herein as the distance ratio. In a typical CRT containing dynamic focusing, the static signal used to focus the beam at the center of the screen is altered to focus the beam at the screen edges. For example, in a CRT using a magnetic focus apparatus, the static focusing current is altered as the beam is scanned on the screen such that focus is maintained over substantially the entire screen. In contrast, in a CRT using an electrostatic focusing element, the static focusing voltage is varied in accordance with the beam position such that the beam remains in focus.

However, using either dynamic electrostatic or dynamic magnetic focusing in a CRT having a small distance ratio requires a great amount of power to drive the focusing apparatus. Also, for certain large, flat screens, it is impossible to achieve a dynamic range sufficient for the focusing apparatus to accurately focus the beam at all locations on the screen.

Therefore, a need exists in the art for apparatus capable of efficiently focusing the electron beam at any location on a CRT screen.

SUMMARY OF THE INVENTION

The present invention overcomes the disadvantages heretofore associated with the prior art CRT focusing apparatus by incorporating within a CRT both a dynamic electrostatic focusing apparatus and a dynamic magnetic focusing apparatus. Consequently, the combined focusing apparatus uses less power than the individual focusing apparatus of the prior art and has a greater dynamic range than that of the prior art apparatus.

Specifically, the present invention is focusing apparatus, associated with a CRT, that applies a dynamic focusing voltage to an electrostatic focus grid of an electron gun and applies a dynamic focusing current to a magnetic focus coil. The electrostatic focus grid is connected to circuitry that supplies the grid with a dynamic focusing voltage. This voltage varies depending on the position of the beam upon the screen. Specifically, the focusing voltage is varied in essentially a parabolic profile as the beam sweeps horizontally for each scanline, e.g., using a maximum focusing voltage at the screen edges and a minimum focusing voltage at the screen center. Additionally, the voltage is slightly varied by the electrostatic focusing apparatus as the beam is vertically scanned. However, to effectuate substantial beam focusing in response to vertical motion of the beam, the magnetic focusing apparatus is used. As such, drive circuitry is connected to the magnetic focus coil and a drive current to the coil is varied in response to the vertical position of the beam. The current varies in essentially a parabolic profile; with the peak current used at the center of the screen and the lowest focus current applied at the top and bottom edges of the screen.

BRIEF DESCRIPTION OF THE DRAWING

To facilitate understanding, identical reference numerals have been used, where possible, to designate identical elements that are common to the figures.

DETAILED DESCRIPTION

Figure 1:
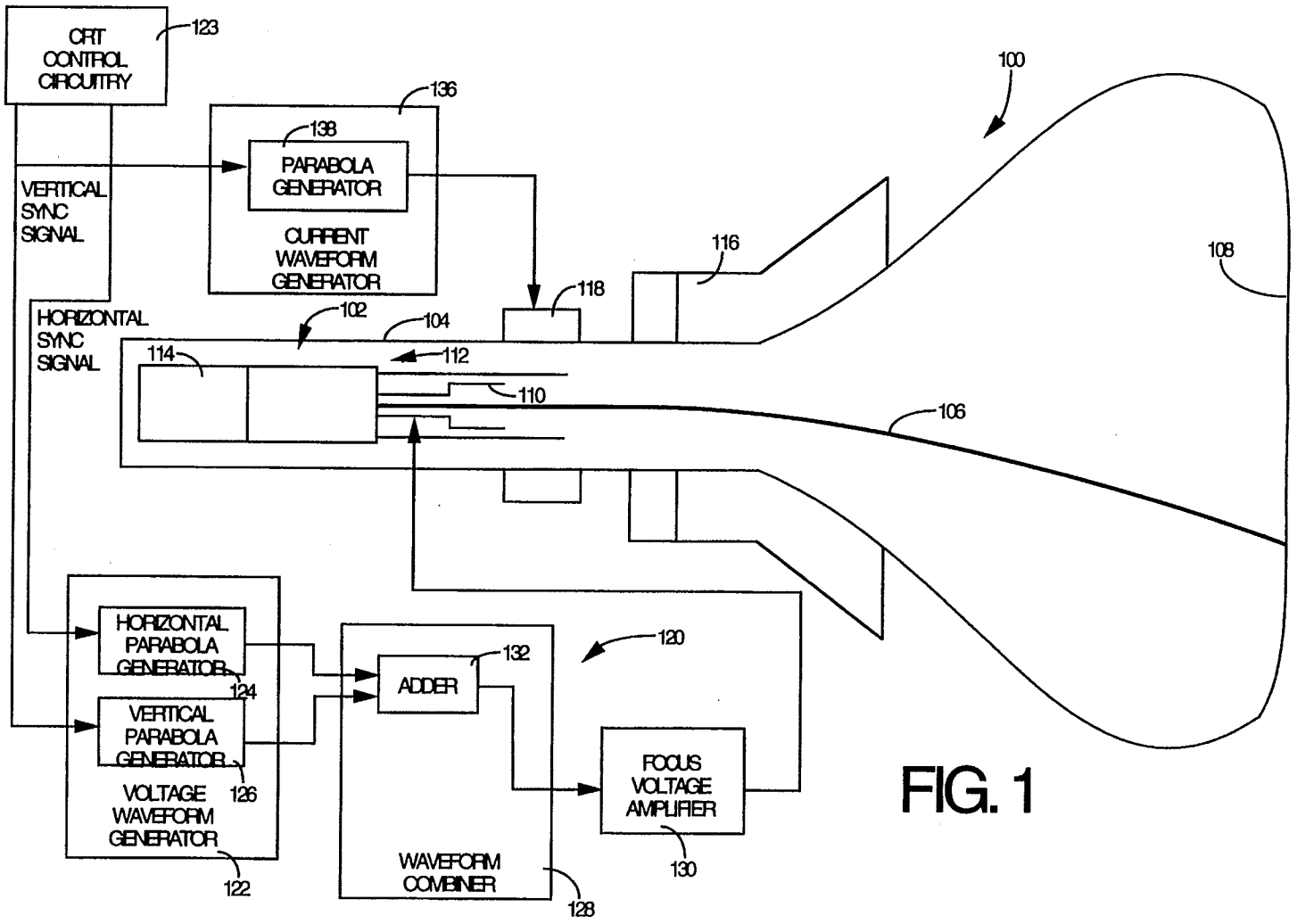
FIG. 1 depicts a block diagram of a preferred embodiment of the present invention.
Figure 2:
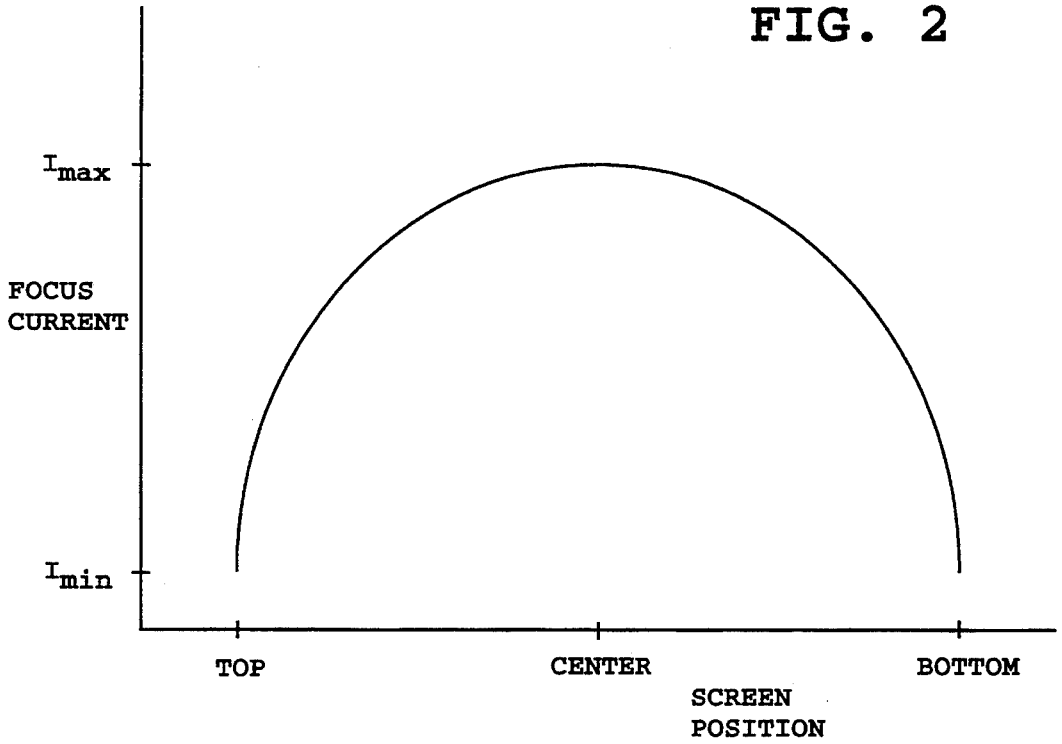
FIG. 2 depicts a graph of the focus current for the magnetic focus apparatus with respect to vertical screen position of the electron beam.

FIG. 1 depicts a block diagram of a preferred embodiment of the present invention. The present invention includes a conventional cathode ray tube (CRT) 100 having an glass envelope 104 containing a vacuum, electron gun 102, located in the neck of the envelope, for producing an electron beam 106, and a luminescent screen 108 that is coated with one or more materials (phosphor) that emit light when impinged by the electron beam. The electron gun is an Einzel gun, although those skilled in the art should understand that other forms of electron guns, such as bi-potential guns, are within the scope of this invention.

As is well known in the art, the Einzel gun contains a heated cathode 114 for generation of electrons and a plurality of grids 112 to organize the electrons into an electron beam. Grid 110 (typically known as the G4 grid) forms an electrostatic focus lens. The grid is formed as a metallic cylinder illustratively having a 0.6 inch entrance diameter and a 0.82 inch exit diameter and a length of 1.5 inches. A grid having these illustrative dimensions possesses a capacitance of approximately 10 pF. The electron beam passes through the cylinder along the central axis thereof. When a static voltage (approximately 11 kV with a 30 kV anode voltage) is applied to the focus grid, an electric field is formed within the grid. This static electric field focuses the beam at the center of the screen. As will be described below, by varying the potential applied to the focus grid, the electrostatic lens is dynamically focused.

To position the electron beam at locations on the screen other than the center, the neck of the CRT is circumscribed by a magnetic deflection yoke 116. As is well known in the art, by applying appropriate currents to the yoke, the electron beam can be pointed to any location on the screen. Typically, the yoke raster scans the beam from left to right and top to bottom of the screen. Each left to right movement of the beam produces a scanline of luminescent pixels on the screen.

A magnetic focus lens 118 is formed as a coil of wire circumscribing the neck of the CRT such that the electron beam passes along the axis of the coil. Illustratively, the coil has an inductance of approximately 200 μH and can carry a peak current of 5 amps. Such a coil is manufactured by Celco of Mahwah, N.J. as model B2810-3. This particular illustrative coil has an inductance of 179 μH and a resistance of 209 Ω. The magnetic lens is located just past the end of the electrostatic lens. In general, the magnetic lens can be located anywhere forward of the electrostatic lens. By applying current to the wire that forms the coil, a magnetic field is generated within the CRT such that the electron beam is further focused. Consequently, the present invention provides both an electrostatic lens and a magnetic lens for focusing the electron beam on the screen.

Electrostatic lens drive circuitry 120 supplies a voltage to the electrostatic lens to produce the electrostatic field used to focus the beam. Typically, a fixed or static potential of approximately 12 kV for a 30 kV anode voltage is used as the static voltage. The static voltage focuses the beam at the center of the screen. However, the focus voltage must be adjusted for beam positions that are offset from the center. As such, the focus voltage is varied as the beam is scanned across the screen (left to right) as well as from top to bottom.

Figure 3:
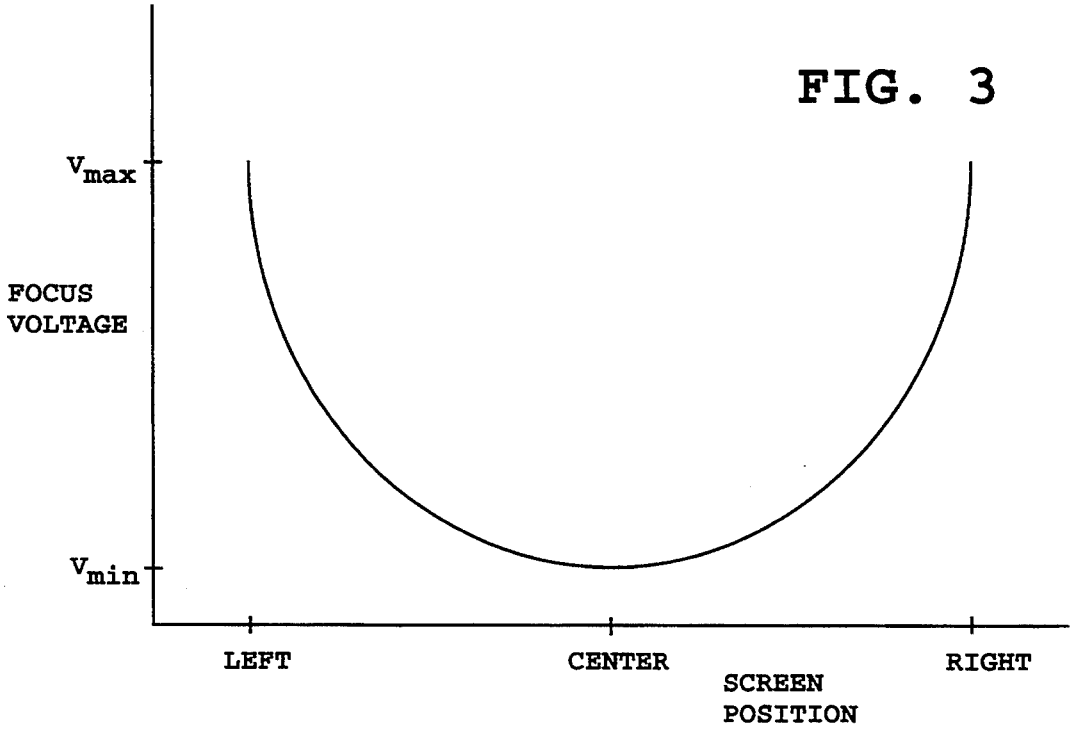
FIG. 3 depicts a graph of the focus voltage for the electrostatic focus apparatus with respect to horizontal screen position of the electron beam.

As shown in FIG. 3, the focus voltage is in the form of a parabola where the trough of the parabola represents the minimum voltage applied to the focus lens, e.g., 12 kV. The minimum voltage occurs at the center of the screen and as the beam is moved to the left or right of the center position, the voltage is increased. The voltage at the end of each line is approximately 13 kV.

Returning to FIG. 1, a voltage waveform generator 122 contains two parabola generators 124 and 126. The waveform generator 122 is triggered by the vertical and horizontal sync signals produced by conventional CRT control circuitry 123. The vertical sync signal indicates the beginning of a frame of video information and the horizontal sync pulse indicates the beginning of each scanline of video information within the frame. Parabola generator 124 produces the parabola for controlling the focus as the beam moves horizontally in each scanline, while parabola generator 126 produces the parabola for controlling the focus as the beam moves vertically on the screen. The respective sync signals trigger the production of the left point of the parabolic voltage. Illustratively, the parabolic functions are programmed in an EPROM such that for each specific beam location (e.g., pixel location) a specific voltage value is recalled from the EPROM. However, other forms of circuitry can be used to produce the parabolic voltage functions that are within the scope of this invention.

In operation, the horizontal voltage waveform electrostatically controls the beam focus as the beam scans from left to right. In practice, the electrostatic beam focus may slightly vary as the beam is moved from top to bottom of the screen. This defocusing as the beam is vertically moved is corrected by adding a vertical voltage parabola to the horizontal voltage parabola. The specific nature of the vertical voltage parabola is defined by the specific CRT incorporating the invention. However, practical constraints such as fabrication cost may require that the slight defocusing as the beam moves from top to bottom of the screen be ignored and, as such, the vertical parabola generator may not be used.

A waveform combiner 128 combines the two parabolic voltage waveforms to produce a composite signal that is amplified by focus voltage amplifier 130 and applied to the focus lens. The combiner contains an adder 132 that adds the values of the two parabolas at any point in time. The composite waveform is amplified and applied to the electrostatic focus lens. Typically, the composite waveform has a maximum voltage of 13 kV at the left and right edges of the screen and a minimum voltage of 12 kV at the center of the screen (assuming no vertical adjustment).

A current waveform generator 136 uses a parabola generator 138 to produce a drive current for the magnetic lens 118. As shown in FIG. 3, the drive current has a parabolic form where the maximum current (5 amps) is applied when the beam is in the center of the screen and lesser amounts of current are applied when the beam is nearer the top or bottom of the screen (zero amps at the top and bottom edges of the screen). The current is adjusted using this parabolic profile as the frame is produced in a top to bottom sweep of the screen. As with the voltage waveform generator, the current waveform generator can be implemented using an EPROM to store the appropriate waveform. In a CRT with a 72 Hz frame rate, the rate of magnetic lens adjustment is 72 Hz.

In an illustrative practical application of the invention, the minimum voltage, i.e., the focus voltage at the center of the screen, is 12 kV and the maximum voltage at the left and right edges of the screen is 13 kV. Thus the focus range of the electrostatic focus is 1 kV. One illustrative CRT that uses the present invention contains 2500 horizontal lines for each frame displayed thereupon at a rate of 72 frames per second. This CRT has a deflection angle of 100 degrees. For such a CRT, the rate at which the focus voltage must be adjusted is 180 kHz. Additionally, for the same illustrative CRT, the magnetic focus current is 5 amps at the center of the screen and zero amps at the top and bottom edges of the screen.

The dynamic focus voltage and current for such a high resolution CRT are respectively only 1 kV and 5 amps because of the use of the magnetic focus lens in addition to the electrostatic focus lens. As such, the power consumed by the electrostatic lens (assuming a frequency of 180 kHz, a lens capacitance of 10 pF and a dynamic voltage range of 1 kV) is 0.09 watts. Furthermore, the power consumed by the magnetic lens (assuming a frequency of 72 Hz, an lens inductance of 200 μH, and a dynamic current range of 5 amps) is 0.18 watts. Consequently, the total power consumed by the dual lens structure is 0.27 watts.

In contrast, without the magnetic focus lens, a CRT of the type discussed above would require in excess of 2 kV to focus the beam using only an electrostatic lens. Varying more than 2 kV at 180 kHz requires costly and complex circuitry, while controlling 1 kV at 180 kHz is rather simple and well within the state of the art in high voltage control circuits. Additionally, a lens with a 2 kV dynamic voltage range consumes 0.36 watts.

Furthermore, if the focus were accomplished using only a magnetic lens, the dynamic current range would be 10 amps operating at a frequency of 180 kHz. Controlling such large currents at 180 kHz requires complex and costly circuitry. Moreover, the power consumed by such a magnetic lens is 1800 watts and would produce significant eddy current heating of the metallic components of the CRT. Such a power consumption is not commercially practical.

Although one embodiment which incorporates the teachings of the present invention has been shown and described in detail herein, those skilled in the art can readily devise many other varied embodiments that still incorporate these teachings.

I claim:

1. Apparatus for focusing an electron beam in a cathode ray tube, said apparatus comprising:

an electrostatic focus lens, circumscribing the electron beam, for generating an electric field having a magnitude that is responsive to a position of said beam on a screen of said cathode ray tube;

a magnetic focus lens, circumscribing said electron beam, for generating a magnetic field having a magnitude that is responsive to a position of said beam on a screen of said cathode ray tube; and wherein, operating simultaneously, said magnetic and electrostatic lenses focus the electron beam at any location on the screen.

2. The apparatus of claim 1 wherein said electrostatic focus lens further comprises a focus grid of an electron gun that produces the electron beam.

3. The apparatus of claim 2 further comprising a first parabolic waveform generator, connected to said electrostatic lens, for generating a first parabolic focus voltage during a scanline of the electron beam.

4. The apparatus of claim 3 further comprising a second parabolic waveform generator, for generating a second parabolic focus voltage that varies as said electron beam moves from top to bottom of said screen and a waveform combiner, connected to said first and second parabolic waveform generators and to said electrostatic lens, for generating, in response to said first and second parabolic voltage waveforms, a composite waveform that controls a magnitude of an electric field generated by said electrostatic lens.

5. The apparatus of claim 2 further comprising a parabolic waveform generator that produces a first parabolic voltage waveform for each scanline of the electron beam and produces a second parabolic voltage waveform for each frame of scanlines, and a waveform combiner for combining said first and second parabolic waveforms to produce a composite waveform that is applied to said electrostatic lens to generate said electric field.

6. The apparatus of claim 1 wherein said magnetic focus lens further comprises a coil circumscribing said electron beam.

7. The apparatus of claim 6 wherein said magnetic focus lens generates said magnetic field in response to a focus current having a parabolic profile as the beam moves from a top of the screen to the bottom of the screen.

8. The apparatus of claim 7 further comprising a parabolic current waveform generator connected to said coil.

9. Apparatus for focusing an electron beam in a cathode ray tube, said apparatus comprising:

an electrostatic focus lens, circumscribing the electron beam, for generating an electric field having a magnitude that is responsive to a position of said beam on a screen of said cathode ray tube;

a parabolic waveform generator for producing a first parabolic voltage waveform for each scanline of the electron beam and for producing a second parabolic voltage waveform for each frame of scanlines, and a waveform combiner for combining said first and second parabolic waveforms to produce a composite waveform that is applied to said electrostatic lens to generate said electric field;

a magnetic focus lens, circumscribing said electron beam, for generating a magnetic field having a magnitude that is responsive to a position of said beam on a screen of said cathode ray tube;

a parabolic current waveform generator, connected to said magnetic lens, for producing a parabolic current waveform having an amplitude that varies in response to the vertical position of the beam on the screen; and wherein, operating simultaneously, said magnetic and electrostatic lenses focus the electron beam at any location on the screen.

10. The apparatus of claim 9 wherein said electrostatic focus lens further comprises a focus grid of an electron gun that produces the electron beam.

11. The apparatus of claim 9 wherein said magnetic focus lens further comprises a coil circumscribing said electron beam.

* * * * *